US007003840B2

(12) United States Patent
Tawara et al.

(10) Patent No.: US 7,003,840 B2
(45) **Date of Patent: *Feb. 28, 2006**

(54) CLEANING DEVICE

(75) Inventors: Hirotoshi Tawara, Tokyo (JP); Yukio Noda, Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/820,735

(22) Filed: Apr. 9, 2004

(65) Prior Publication Data

US 2004/0187236 A1 Sep. 30, 2004

Related U.S. Application Data

(62) Division of application No. 09/984,766, filed on Oct. 31, 2001, now Pat. No. 6,783,600.

(30) Foreign Application Priority Data

| | | |
|---|---|---|
| Nov. 1, 2000 | (JP) | 2000-335014 |
| Feb. 7, 2001 | (JP) | 2001-031547 |
| Apr. 12, 2001 | (JP) | 2001-114645 |
| Apr. 12, 2001 | (JP) | 2001-114646 |
| Oct. 12, 2001 | (JP) | 2001-315993 |

(51) Int. Cl.
*A47L 11/33* (2006.01)

(52) U.S. Cl. ..... 15/41.1; 15/48; 15/52.1; 15/98

(58) Field of Classification Search ..... 15/104.002, 15/98, 52.1, 48.1, 48, 44, 41.1, 27
See application file for complete search history.

(56) References Cited

U.S. PATENT DOCUMENTS

| | | | |
|---|---|---|---|
| 2,211,533 A | 8/1940 | Boye | 15/246 |
| 4,640,539 A | 2/1987 | La Porte | |
| 4,642,831 A | 2/1987 | Roth | |

FOREIGN PATENT DOCUMENTS

| | | |
|---|---|---|
| DE | 1 934 025 | 1/1971 |
| DE | 2 060 377 | 6/1971 |
| DE | 299 13 845 | 12/1999 |
| GB | 599944 | 3/1948 |
| GB | 1 241 625 | 8/1971 |
| JP | 59-139261 | 9/1984 |
| JP | 63-163767 | 10/1988 |
| JP | 2-12363 | 1/1990 |
| JP | 10-5159 | 1/1998 |
| JP | 11-318789 | 11/1999 |

OTHER PUBLICATIONS

Patent Abstracts of Japan, JP 11-206698, Aug. 3, 1999.
Patent Abstracts of Japan, JP 7-327912, Dec. 19, 1995.
Patent Abstracts of Japan, JP 4-244128, Sep. 1, 1992.

*Primary Examiner*—Mark Spisich
(74) *Attorney, Agent, or Firm*—Oblon, Spivak, McClelland, Maier & Neustadt, P.C.

(57) ABSTRACT

In a cleaning device, the scraping up body and the rotating body rolling the adhesive roll are rotatably supported to the frame, and the adhesive roll is rotatably arranged on the scraping up body and the rotating body in parallel.

20 Claims, 7 Drawing Sheets

CLEANING DEVICE

CROSS REFERENCE TO RELATED APPLICATIONS

The present application is a division of U.S. application Ser. No. 09/984,766 filed Oct. 31, 2001, now U.S. Pat. No. 6,783,600 and is based on Japanese patent application No. 2000-335014 filed on Nov. 1, 2000, No. 2002-031547 filed on Feb. 7, 2001, No. 2001-114645 filed on Apr. 12, 2001, No. 2001-114646 filed on Apr. 12, 2001 and No. 2001-315995 filed on Oct. 12, 2001 each of which is incorporated herein by reference in its entirety.

BACKGROUND OF THE INVENTION

1. Field of the Invention

The present invention relates to a cleaning device.

2. Description of the Related Art

As a cleaning device, there is known a structure in which a brush body and an adhesive roll are independently provided and which independently collect dust (Japanese Utility Model Application Laid-open No. 59-139261), and a structure in which an adsorption surface of a primary adsorbing roller and an adhesive sheet of a secondary adsorbing roller are rotated in contact so as to transfer dust attached to the primary adsorbing roller to a side of the adhesive sheet (Japanese Utility Model Application Laid-open No. 2-12363).

The prior arts mentioned above have the following problems.

(1) When cleaning a carpet using the adhesive roll, the adhesive roll adheres fibers constituting the carpet, thereby damaging the carpet.

(2) When cleaning a flooring using the adhesive roll, the adhesive roll strongly adheres the flooring so as to be immobilized, thereby making it impossible to roll the adhesive roll.

(3) Since hairs or the like become wound around the brush body, it is hard to maintain a stable cleaning performance.

Further, as a cleaning device, there is known a structure in which an electrostatic generating roller and an adhesive roll are rotated in contact, and both the electrostatic generating roller and the adhesive roll are elastically held in contact with each other by a spring pulling the adhesive roll to a side of the electrostatic roller, whereby dust adhering to the electrostatic generating roller becomes attached to the adhesive roll so as to collect the dust (Japanese Utility Model Application Laid-open No. 63-163767).

In this prior art, the following problems exist.

(1) Since the electrostatic generating roller rolls while pressing the carpet from a surface thereof, it is impossible to pick up dust in a deep portion of the fiber of the carpet, so that it is hard to improve a cleaning performance.

(2) When making an adhesive force of the adhesive roll strong in order to securely adhere the dusts attached to the electrostatic generating roller to the adhesive roll, the electrostatic generating roller adheres to the adhesive roll, whereby a rotation operating force applied to the electrostatic generating roller by a user becomes heavy.

SUMMARY OF THE INVENTION

An object of the present invention is to make it possible to stably clean the carpet and the flooring for a long time.

Another object of the present invention is to improve an operability of a cleaning device by a user, and improve a performance of picking up dust.

In accordance with the present invention, the above and other objects are achieved by a cleaning device comprising a frame; a scraping up body; an adhesive roll; and a rotating body rolling with the adhesive roll, wherein the scraping up body and the rotating body are rotatably supported to the frame, and the adhesive roll is rotatably arranged on the scraping up body and the rotating body in parallel.

BRIEF DESCRIPTION OF THE DRAWINGS

The present invention will be more fully understood from the detailed description given below and from the accompanying drawings which should not be taken to be a limitation on the invention, but are for explanation and understanding only.

DESCRIPTION OF THE PREFERRED EMBODIMENTS (First Embodiment) (FIGS. 1 to 4)

Figure 1:
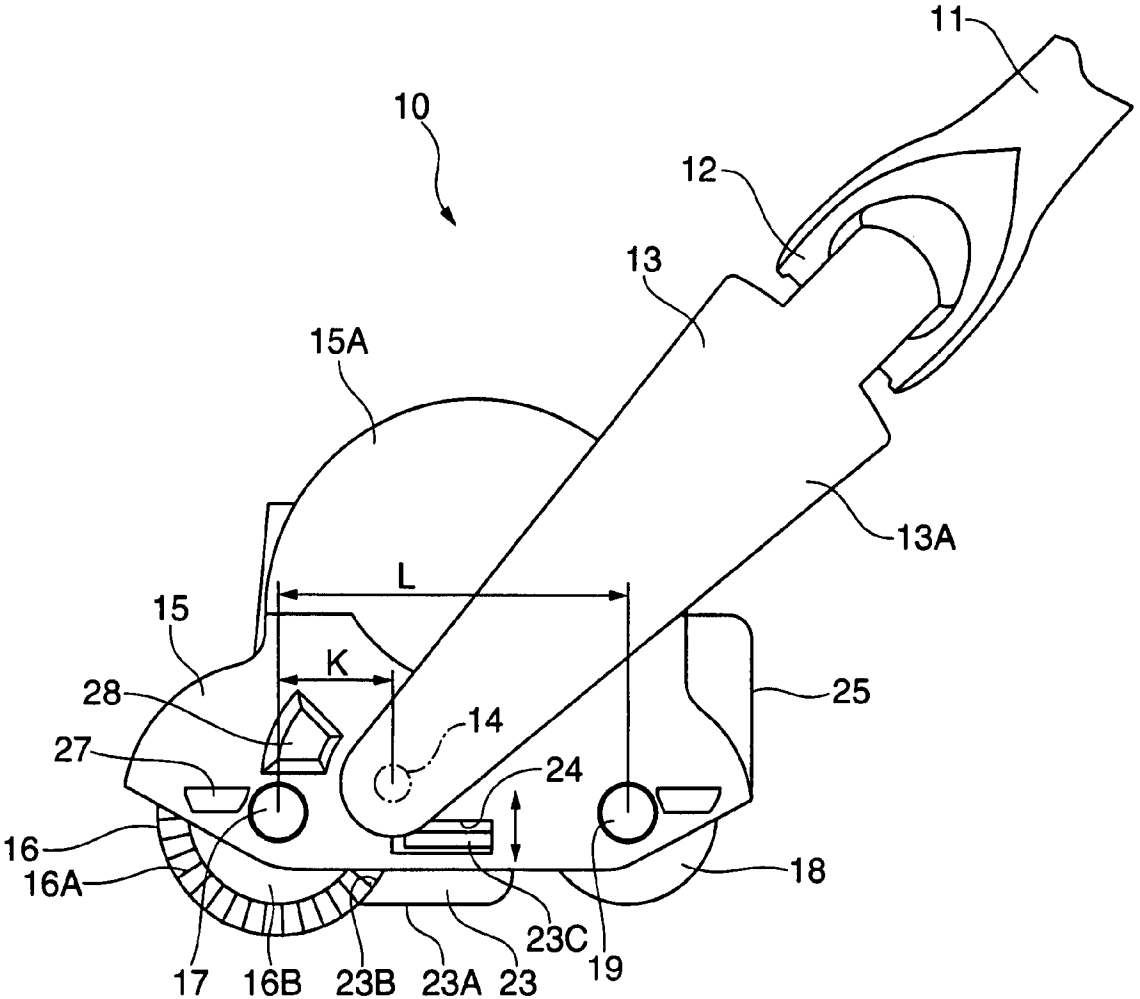
FIG. 1 is a side elevational view showing a cleaning device in accordance with a first embodiment.
Figure 2:
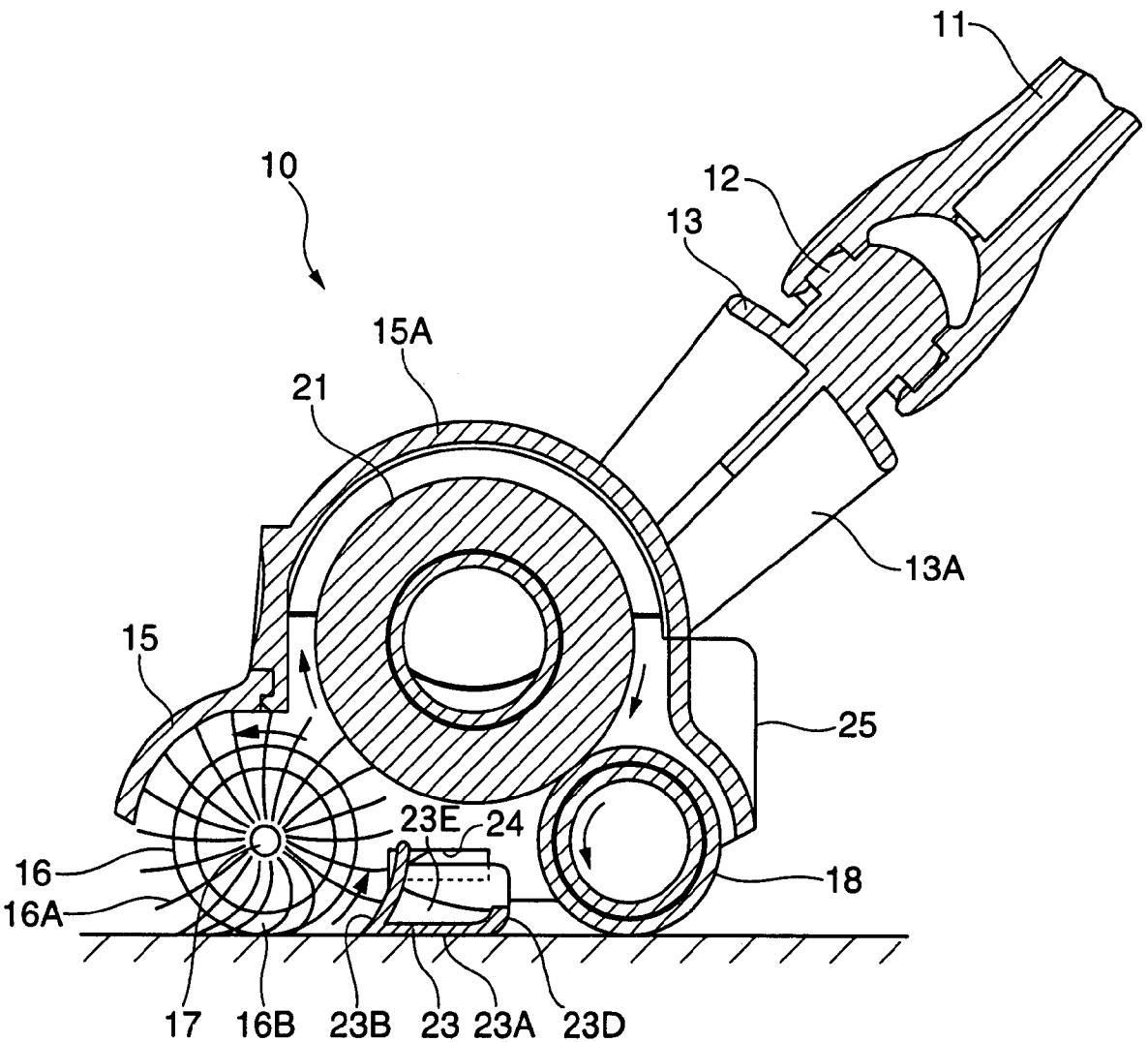
FIG. 2 is a cross sectional view of FIG. 1.

A cleaning device 10 is structured, as shown in FIGS. 1 and 2, such that a supporting arm 13 is connected to a front end portion of a handle 11 via a joint portion 12 in such a manner as to freely swing in a lateral direction, and a frame 15 is supported to both side arm portions 13A of the supporting arm 13 via a supporting shaft portion 14 in such a manner as to freely swing in a longitudinal direction.

Figure 7:
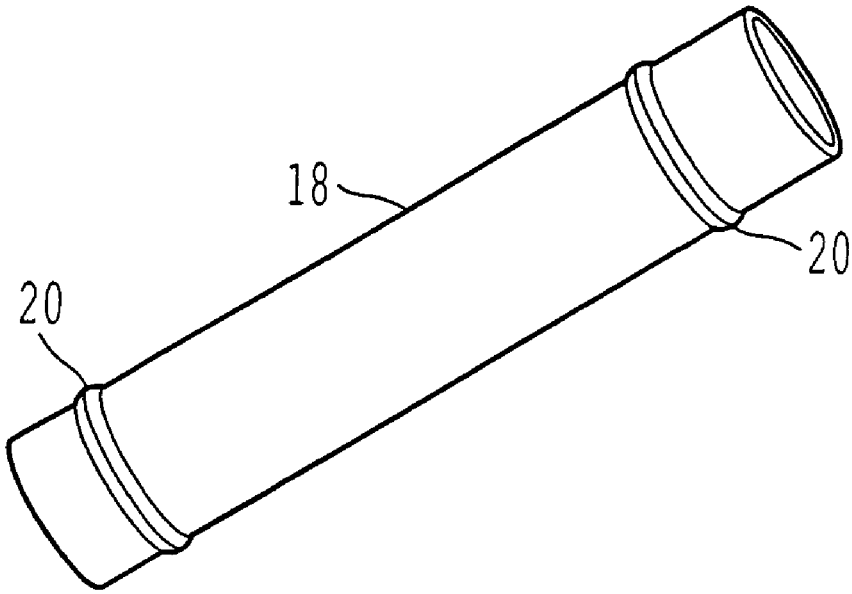
FIG. 7 is a perspective view of an exemplary rotating body with two concavo-convex portions.

A scraping up body 16 constituted by a brush is rotatably supported at a front portion of the frame 15 via a rotational shaft 17, a contact rotating body 18 constituted by a roll body is in contact with an adhesive roll 21 and capable of rotating with the adhesive roll 21 is rotatably supported at a rear portion of the frame 15 via a rotational shaft 19. The scraping up body 16 and the contact rotating body 18 are arranged in parallel. The scraping up body 16 is constituted by a scraping up portion 16A (a brush portion) and a tire portion 16B. The scraping up diameter (brush diameter) of the scraping up portion 16A is made larger than a tire diameter of the tire portion 16B. The contact rotating body 18 is structured such that a surface thereof is formed by an elastic body, and constituted, for example, by a siliconerubber. In this case, the contact rotating body 18 may be formed by an inelastic body, and further, a concavo-convex portion may be provided on a surface of the contact rotating body 18. The concavo-convex portion can form a rib, a convex portion, a recess portion, a crimping surface or the like on a roll surface of the contact rotating body 18. Further, the concavo-convex portion can roll on the adhesive roll 21. Or the concavo-convex portion can reduce the rotational coupling force between the adhesive roll 21 and the contact rotating body 18 by decreasing contact area between the adhesive roll 21 and the contact rotating body 18. For example, FIG. 7 shows an exemplary rotating body 18 with two concavo-convex portions, namely ribs 20.

The adhesive roll 21 has no rotational shaft and rides on the scraping up body 16 and the contact rotating body 18. The adhesive roll 21 rotates so as to interlock with the rotation of the scraping up body 16 and the contact rotating body 18. Especially, due to the adhesive forth working between the adhesive roll 21 and the contact rotating body 18, the adhesive roll 21 rotates so as to interlock with the rotation of the contact rotating body. A take in and out port for the adhesive roll 21 is provided in an upper portion of the frame 15 and is covered by a detachable transparent cover 15A. The adhesive roll 21 can be either a take-up roll of an adhesive sheet or an adhesive elastomer surface which is reusable by being cleaned, or the like. The adhesive roll 21 in accordance with the present embodiment is constituted by a take-up roll of an adhesive sheet in which an adhesive surface facing outside can be wound off and cut. As adhesive agent applied on a base material in the adhesive sheet, a hot melt type, a solvent type, and a water type adhesive agents can be mentioned. As a hot-melt type adhesive agent, a styrene type, and an olefin type can be mentioned. As a solvent type adhesive agent, a styrene type, and an olefin type, and an acrylic type can be mentioned. As a water type adhesive agent, an acrylic type can be mentioned. These adhesive agents are preferable in view of sure-adhering and holding dust such as hairs or breadcrumbs. Further, an amount of application of an adhesive agent on a base material in the adhesive sheet is preferably set to be between 25 and 50 $g/m^2$ and more preferably between 25 and 35 $g/m^2$. In this case, as a method of rolling the adhesive roll 21, in addition to the method of rotating together with the contact rotating body 18, it is possible to employ a method of rotating in an interlocking manner by connecting the adhesive roll 21 and the rotating body 18 by a belt, or a method of rotating in an interlocking manner by connecting the adhesive roll 21 and the scraping up body 16 by a belt, or the like.

A dustpan body 23 is supported at a rear portion of the scraping up body 16 in the frame 15. The dustpan body 23 has a bottom surface portion 23A in contact with a floor surface, and a scooping surface portion 23B facing the scraping up body 16 with no gap (or via a gap) and formed in a curved surface shape (or a flat surface shape). Flat supporting shaft portions 23C in both sides of the dustpan body 23 are supported by rectangular holes 24 in both sides of the frame 15 so as to freely move in a vertical direction. The dustpan body 23 moves in a vertical direction due to the rectangular holes 24, because the rectangular holes 24 are bigger than the supporting shaft portions 23C in the vertical direction. The dustpan body 23 guides all the dust scraped up by the scraping up portion 16A of the scraping up body 16 to the adhesive roll 21 by the scooping surface portion 23B without permitting the dust to move rearward along the floor surface, by vertically moving the supporting shaft portions 23C with respect to the rectangular holes 24 and bringing the bottom surface portion 23A and the lowermost end portion of the scooping surface portion 23B into contact with the floor surface with no gap, due to their own weights.

In this case, the cleaning device 10 is structured such that when a horizontal distance between the rotational shaft 17 of the scraping up body 16 and the rotational shaft 19 of the contact rotating body 18 is set to L, and a horizontal distance between the rotational shaft 17 of the scraping up body 16 and the supporting shaft portion 14 of the supporting arm 13 is set to K, a relation $K<L/2$ is established, and an operating force applied by the user in an axial direction of the handle 11 increases a moment pressing the scraping up body 16 to the floor surface, thereby placing the tire portion 16B on the floor surface on the basis of a light operating force so as to make it possible to smoothly start a cleaning operation.

The cleaning operation by the cleaning device 10 is performed in the following manner.

(1) The operating force applied to the handle 11 in the axial direction moves the cleaning device 10 forward, rotates the tire portion 16B of the scraping up body 16 and the contact rotating body 18, and simultaneously rotates the adhesive roll 21 in an interlocking manner.

(2) When the scraping up portion 16A of the scraping up body 16 scrapes up the dust on the floor surface, the dust is guided by the dustpan body 23 so as to be fed to the adhesive roll 21, and is adhered onto the adhesive surface of the adhesive roll 21.

(3) The dust picked up on the adhered surface of the adhesive roll 21 moves to the contact rotating body 18 due to the rotation of the adhesive roll 21, and is pressed onto the adhesive surface of the adhesive roll 21 by the contact rotating body 18 so as to be fixed thereto.

(4) When it can be seen via a transparent cover 15A that the adhesive surface of the adhesive roll 21 is completely covered with dust, the cover 15A is opened and the adhesive roll 21 is take out to be cut to remove the outermost adhesive sheet so as to expose a new adhesive surface, and then the adhesive roll 21 is again placed on the scraping up body 16 and the contact rotating body 18, and the cover 15A is closed.

In this case, the cleaning device 10 can not only move forward but also backward, and at a time of moving backward, the dust on the floor surface attached to the contact rotating body 18 can be adhered by the adhesive roll 21. The dustpan body 23 is formed in an upward curved shape at a tail end portion 23D of the bottom surface portion 23A, thereby preventing the tail end portion 23D from being caught on the floor surface at a time of backward moving. Further, because the tail end portion 23D is formed in an upward curved shape, the bottom surface portion 23A, the scooping surface portion 23B and the tail end portion 23D form a dustpan concave portion 23E, and the dust fallen into the dustpan concave portion 23E can be held.

Figure 3:
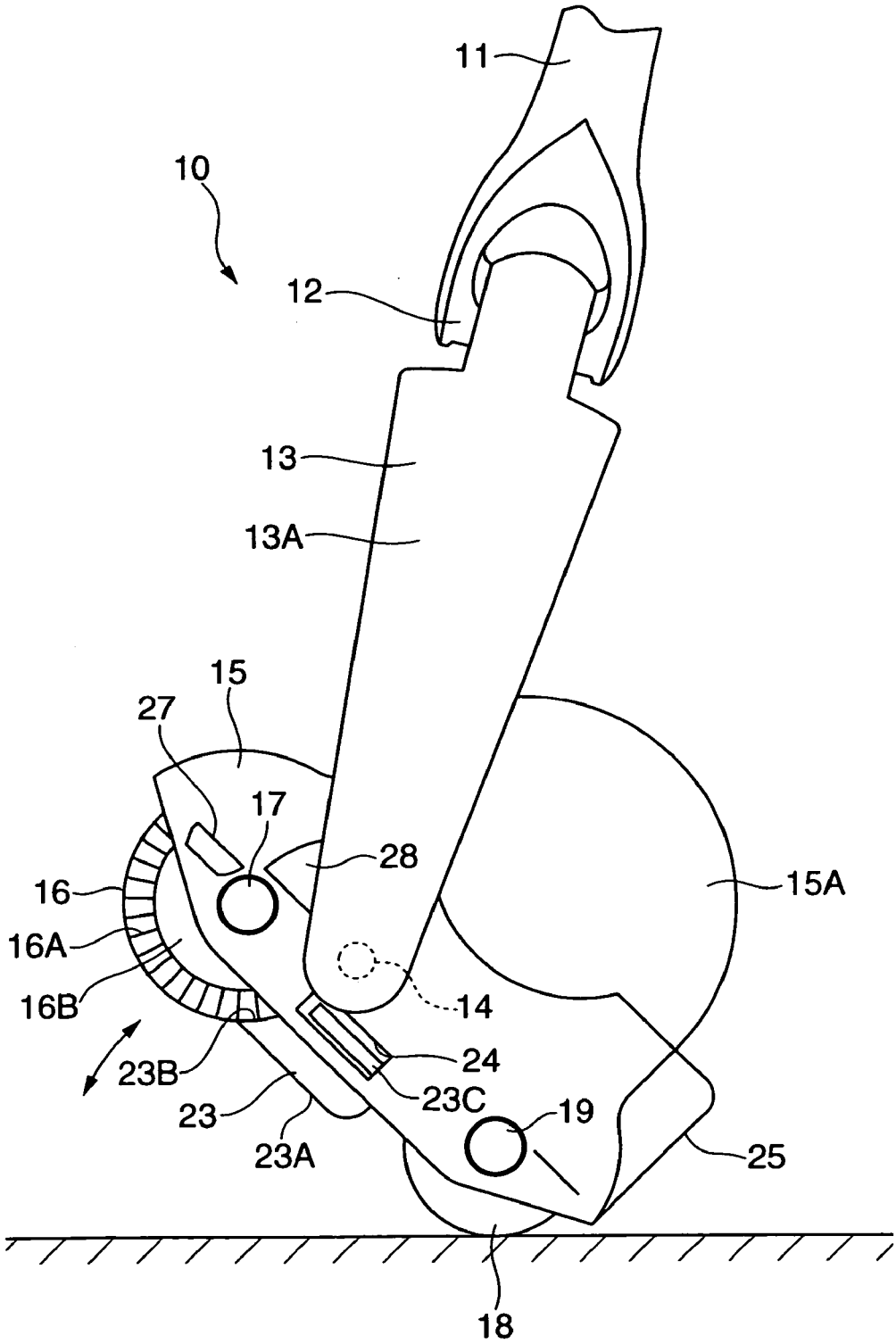
FIG. 3 is a side elevational view showing a lift-up state of the cleaning device in accordance with the first embodiment.

Further, in the cleaning device 10, as shown in FIG. 3, the scraping up body 16 is positioned forward and upward in comparison with the contact rotating body 18 in a state of lifting up the frame 15 by the handle 11 and the supporting arm 13, and so the frame 15 pivots around the supporting shaft portion 14 of the supporting arm 13 due to its weight.

Figure 4:
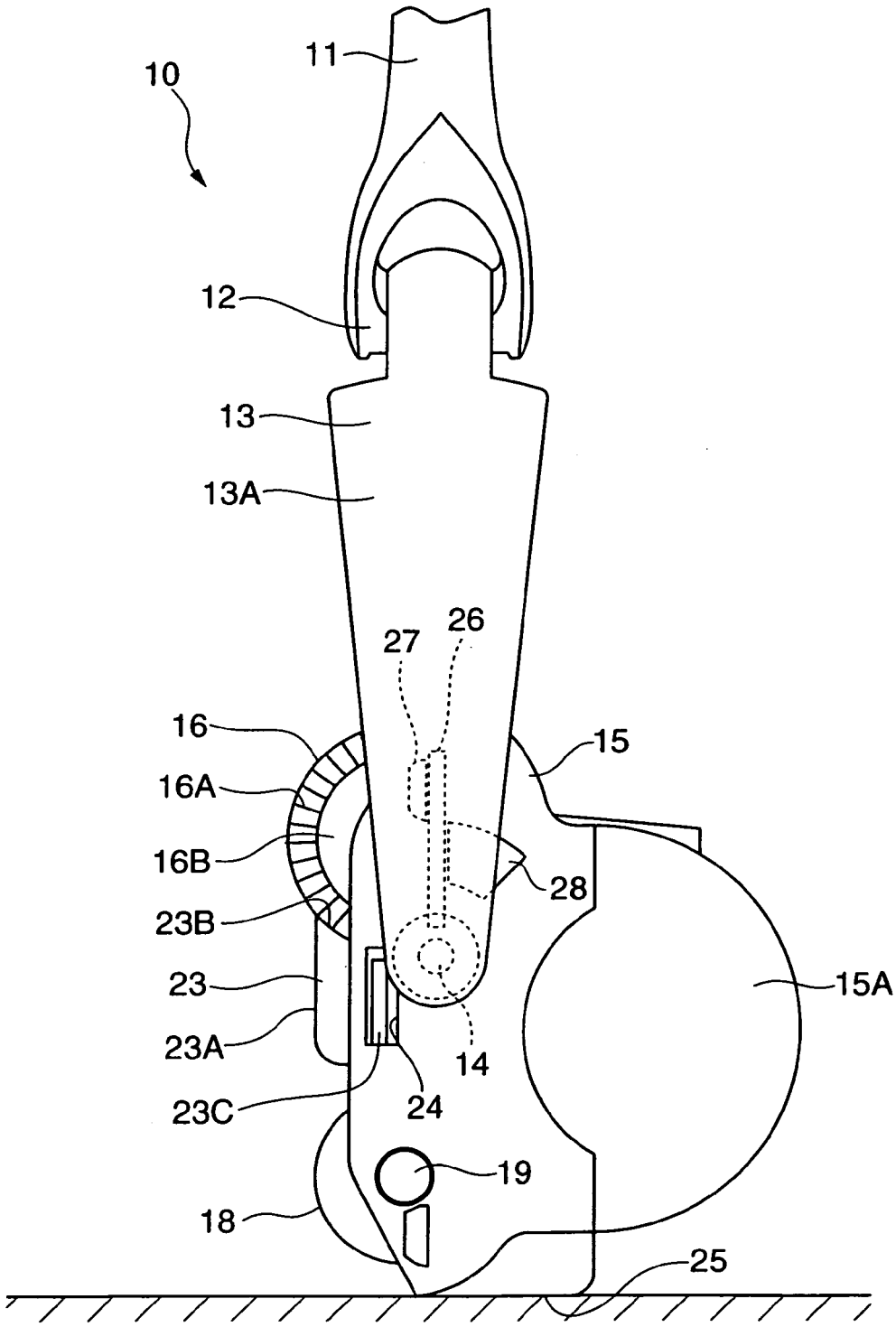
FIG. 4 is a side elevational view showing a stand-up storage state of the cleaning device in accordance with the first embodiment.

Further, in the cleaning device 10, as shown in FIG. 4, a leg portion 25 for permitting the frame 15 sit on the floor surface in a stand-up state is provided in the frame 15. Further, as an arm holding means for holding the supporting arm 13 in a vertically upward direction with respect to the frame 15 in the stand-up state, there are provided with a rib 26 formed on an inner side surface of the supporting arm 13, and a stopper 27 and a climb-over pawl 28 formed in a side portion of the frame 15, so that when moving the supporting arm 13 from a normal use state shown in FIGS. 1 and 2 to the stand-up state, the rib 26 climbs over the climb-over pawl 28 and is held between the climb-over pawl 28 and the stopper 27.

In accordance with the present embodiment, the following effects can be obtained.

(1) In the carpet, the dust is scraped up by the scraping up body 16 and thereafter the dust is adhered and picked up onto the adhesive roll 21. Since the adhesive roll 21 is not directly in contact with the carpet, the carpet is not damaged and a persistence of the adhesion performance of the adhesive roll 21 is improved. Since the carpet fibers need not to be adhered, a lot of dust that should be adhered can be adhered instead of them.

In this case, the adhesive roll 21 may instead be structured such that the rotational shaft thereof is supported to the frame 15 and the adhesive roll 21 is not in contact with the scraping up body 16. That is, there is no contact between the scraping up body 16 and the adhesive roll 21, and it is preferable to set a distance between the brush end portion of the scraping body 16 and the outermost peripheral surface of the adhesive roll 21 to about 2 to 3 mm in view of the adhesiveness of the dust.

(2) With respect to the flooring, in the same manner with carpet, since the adhesive roll 21 does not directly contact with the flooring, the adhesive roll 21 is not adhered to the flooring.

(3) The dust scraped up by the scraping up body 16 is immediately adhered to the adhesive roll 21 so as to be removed, the hairs or the like are not wound around the scraping up body 16 and are not left there, the scraping up body 16 is always cleaned due to the contact with the adhesive roll 21 and a cleaning performance thereof is stably maintained.

(4) The contact rotating body 18 mounts the adhesive roll 21 thereon, and it securely and simultaneously rotates with the adhesive roll 21 in an interlocking manner. Accordingly, it is possible to evenly and effectively make good use of the adhesive surface of the adhesive roll 21 in contact with the scraping up body 16, and it is possible to securely adhere and pick up the dust scraped up by the scraping up body 16 by the new adhesive surface of the adhesive roll 21. At this time, since the adhesive roll 21 may ride over both of the scraping up body 16 and the contact rotating body 18, it is possible to attach any kinds of adhesive rolls 21 having several kinds of large and small outer diameters to the cleaning device 10. Accordingly, freedom of manufacturing can be had for the outer diameter of the adhesive roll 21, and it is possible to select an adhesive roll 21 having a proper outer diameter in correspondence to the floor condition.

(5) The contact rotating body 18 presses the dust adhered and picked up by the adhesive roll 21 to the adhesive surface of the adhesive roll 21 so as to fix the pick-up state of the dust. In this case, the dust which the contact rotating body 18 picks up due to the contact with the floor surface are adhered and picked up by the adhesive roll 21, and the adhesive roll 21 keeps the contact rotating body 18 clean. That is, at the time of cleaning, the adhesive roll 21 and the contact rotating body 18 pick up the dust in contact state. Before cleaning or in correspondence to the cleaning condition, the adhesive roll 21 and the contact rotating body 18 may be in contact or non-contact state.

(6) Since the adhesive roll 21 can be supported by the scraping up body 16 and the contact rotating body 18, it is possible to make the supporting shaft for supporting the adhesive roll 21 to the frame 15 or the like unnecessary. It is easy to replace the adhesive roll 21 and it is possible to keep the rotation of the adhesive roll 21 from being resisted due to a supporting shaft contact fault at a time of cleaning. Further, it is possible to reduce the cost of the cleaning device 10.

(7) It is possible to form a closed space surrounded by the scraping up body 16, the contact rotating body 18 and the adhesive roll 21 on the floor surface and it is possible to keep the dust scraped up by the scraping up body 16 in the closed space so as to pick it up. Accordingly, the dust is not diffused widely and the peripheral portion is not made dirty.

(8) It is possible to arrange the adhesive roll 21 upward in the rear portion in the rotational direction of the scraping up body 16 and at the position close to the scraping up body 16, and it is possible to pick up the dust scraped up by the scraping up body 16 immediately close thereto in the scraping up direction by the adhesive roll 21. It is unlikely to miss the scraped up dust.

(9) The dust which the scraping up body 16 scrapes up from the deep portion in the fiber of the carpet, and the dust which the scraping up body 16 scrapes rearward from the hard flat surface of the flooring are also scooped up by the dustpan body 23 in the rear portion of the scraping up body 16 so as to be securely guided in a direction of the adhesive roll 21, whereby it is possible to improve a dust collecting performance.

(10) Since the scraping up body 16 is provided with the tire portion 16B, the tire portion 16B is pressed to the floor surface due to the weight of the cleaning device 10 so as to rotate, thereby securely rotating the scraping up body 16. Since the scraping up diameter is larger than the tire diameter, the scraping up portion 16A strongly scrapes up the dust due to the rebound force of bending deflection so as to improve the scraping up performance, and the dust in the deep portion of the carpet fiber can be well scraped out.

(11) Since the scraping up portion 16A and the tire portion 16B of the scraping up body 16 are concentrically formed and the tire portion 16B rotates while being pressed to the floor surface, the scraping up portion 16A rotates in a direction of scraping up the dust on the floor surface rearward with respect the forward moving direction of the cleaning device 10 (a forward direction). Accordingly, it is possible to take in the scraped up dust by the dustpan body 23 and the adhesive roll 21 inside the frame 15 without pressing the dust out of the frame 15.

(12) Since the scraping up portion 16A of the scraping up body 16 rotates in the forward direction mentioned above, the dustpan body 23 is arranged close to the rear portion of the scraping up portion 16A, so that the dustpan body 23 does not interfere with the intake of dust into the cleaning device 10 moving in the forward direction. On the contrary, in the case that the scraping up portion 16A of the scraping up body 16 rotates in a reverse direction due to a gear train being interposed between the scraping up portion 16A and the tire portion 16B or the like, the dustpan body 23 is arranged close to the front portion of the scraping up portion 16A, and the dust taken in is caught in the dustpan body 23 in the front portion of the scraping up portion 16A, whereby it is possible to prevent the dust from moving forward to the scraping up portion 16A. Further, when arranging the dustpan body 23 in the forward portion of the scraping up portion 16A and upward from the floor surface, the dustpan body 23 does not prevent the dust from moving forward to the scraping up portion 16A. However, the dustpan 23 passes the dust scraped up by the scraping up portion 16A straight therethrough from the lower portion of the dustpan 23, whereby the dust cannot be taken in the dustpan body 23 and the adhesive roll 21.

(13) The contact rotating body 18 is provided with an elastic body surface, whereby it is possible to firmly press and fix the dust adhered and picked up in the adhesive roll 21 to the adhesive surface of the adhesive roll 21.

(14) In the case that the adhesive force of the adhesive roll 21 is strong, since the adhesive roll 21 and the contact rotating body 18 rotate together, it is hard to rotate them, and the operation becomes heavy. Accordingly, it is possible to lighten the rotation by providing at least two concavo-convex portions on the surface of the contact rotating body 18. That is, by providing the concavo-convex portion in the contact rotating body, it is possible to form a gap between the adhesive roll 21 and the contact rotating body 18, whereby it is possible to reduce the contact area between the two and to improve operability. Since the dust attached to the contact rotating body 18 is transferred to the adhesive roll 21 without a close attachment between the adhesive roll 21 and the contact rotating body 18, a height of the concavo-convex portion is preferably between 0.1 and 0.5 mm, and more preferably between 0.2 and 0.4 mm. In this case, the concavo-concave portion corresponds to a structure obtained by applying a rib, a convex portion, a recess portion, a crimping surface or the like to the surface of the contact rotating body 18.

(15) At a time of storing the cleaning device 10, it is possible to hold the supporting arm 13 vertically upward with respect to the frame 15 in the standing-up state and sit the leg portion 25 of the frame 15 in the standing-up state on the floor surface, whereby it is possible to stably store the device in a compact attitude. Since the scraping up body 16 does not sit on the floor surface during the storage, the scraping up body 16 does not wear out and it is possible to stably maintain the scraping up performance thereof.

The amount of application of the adhesive agent on the base material of the adhesive roll can not be conventionally increased so much due to the need to avoid pick-off of flocked fabrics in the carpet or the like, since the conventional adhesive roll is directly transferred to the surface to be cleaned, so that the amount has been between 10 and 20 g/m$^2$. Accordingly, the dust covers the surface of the adhesive roll, and the adhesive force is weakened, whereby a surface capable of cleaning the floor (an area maintaining a cleaning force) after the new adhesive surface is exposed is small. On the contrary, in accordance with the present invention, since the adhesive roll is not directly in contact with the surface to be cleaned, the amount of application of the adhesive agent on the adhesive roll can be increased, so that it is possible to increase the cleaning force maintaining area. In accordance with the present invention, the amount of application of the adhesive agent on the base material of the adhesive roll is preferably between 25 and 50 g/m$^2$ for the purpose of securing a proper peeling force until the adhesive surface is replaced by a new adhesive surface, and is more preferably between 25 and 35 g/m$^2$.

Further, in accordance with the embodiment mentioned above, in a state of lifting up the frame 15 by the supporting arm 13, the scraping up body 16 is positioned forward and upward with respect to the contact rotating body 18. Accordingly, since the contact rotating body 18 is first placed and thereafter the scraping up body 16 is placed at a time of placing the frame 15 on the floor surface by the supporting arm 13, it is possible to smoothly start cleaning.

The contact rotating body 18 and the adhesive roll 21 need not to rotate complete-simultaneously in an interlocking manner. They can rotate with slightly sliding each other.

Figure 5:
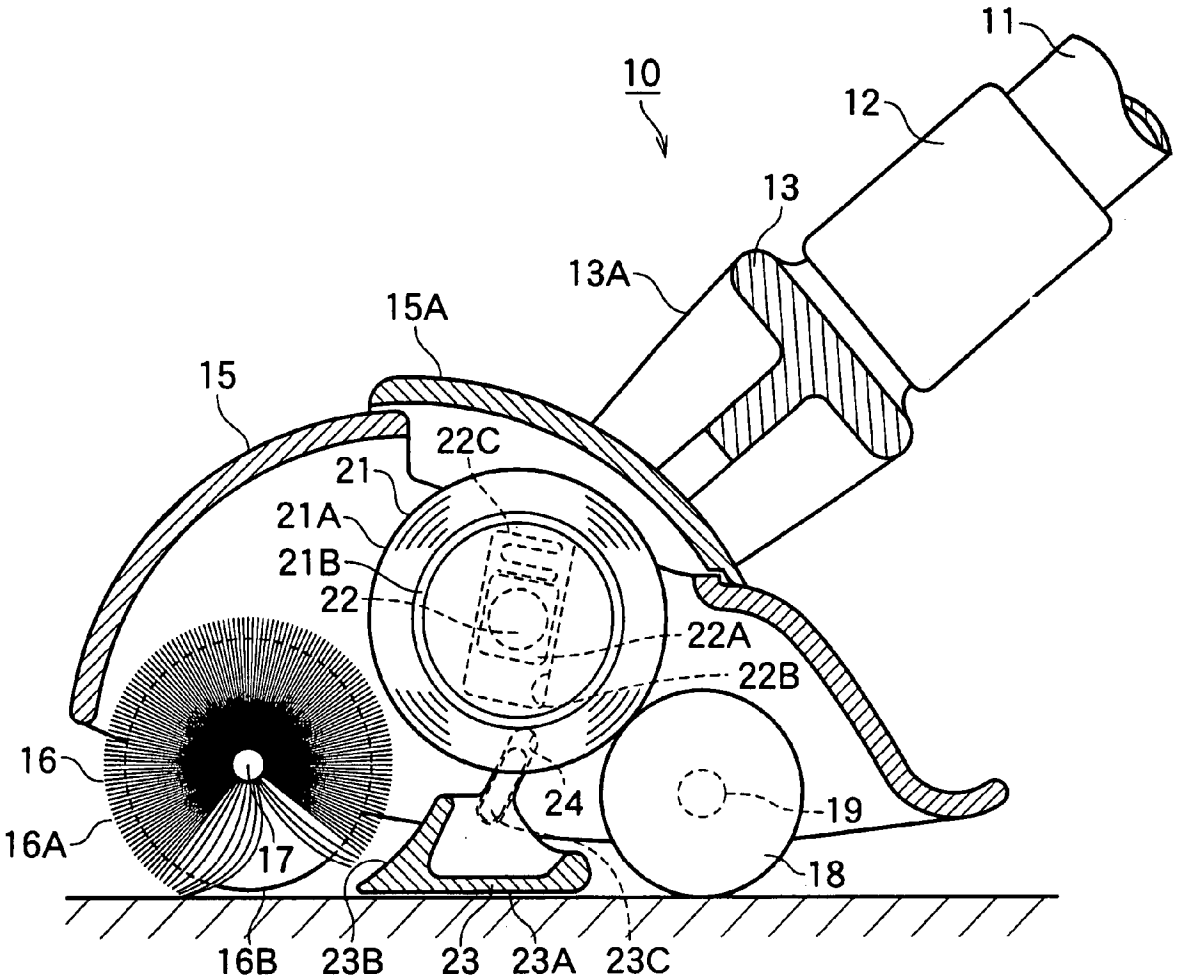
FIG. 5 is a side cross sectional view showing a cleaning device in accordance with a second embodiment.
Figure 6:
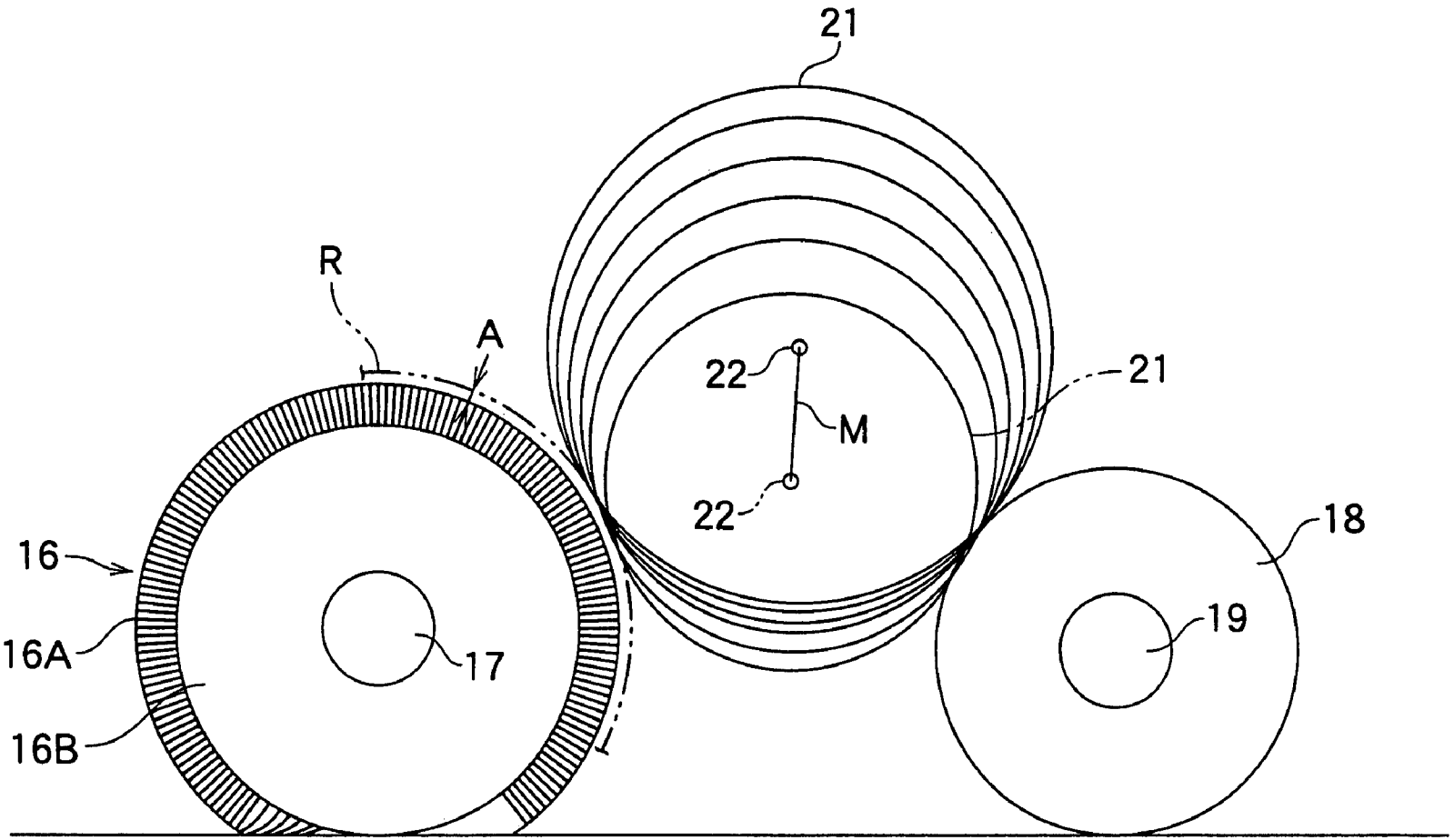
FIG. 6 is a schematic view showing an expected track of a rotary shaft of an adhesive roll.

(Second Embodiment) (FIGS. 5 and 6)

In a second embodiment, the same reference numerals are applied to the same elements as those of the first embodiment and the description thereof will be omitted.

In the second embodiment, the adhesive roll 21 is rotatably supported on the scraping up body 16 and the contact rotating body 18 via the rotational shaft 22 so as to ride over them in such a manner as to be freely rotated in parallel thereto, and the adhesive roll 21 rotates so as to interlock with the rotation of the scraping up body 16 and the contact rotating body 18. A take in and out port for the adhesive roll 21 is provided in an upper portion of the frame 15 and is covered by a detachable transparent cover 15A. The adhesive roll 21 may be a take-up roll of an adhesive sheet or an adhesive elastomer surface reusable by being cleaned. The adhesive roll 21 in accordance with the present embodiment is constituted by a take-up roll having an adhesive sheet 21A wound around a core 21B, and an adhesive surface of the adhesive sheet 21A facing outside can be wound off and cut. In this case, an amount of application of an adhesive agent on a base material in the adhesive sheet 21A is preferably set to be between 25 and 50 g/m$^2$ and more preferably between 25 and 35 g/m$^2$.

In this case, the rotational shaft 22 of the adhesive roll 21 is movably supported by supporting guides 22B formed in a rectangular hole shape and provided in both side portions of the frame 15 via bearing sliders 22A in both ends for the purpose of bringing the adhesive roll 21 into contact with the contact rotating body 18 and keeping a distance relation (a distance of 0 or a small gap A) between the adhesive roll 21 and an outer diameter of the scraping up body 16 (a scraping up diameter of the scraping up portion 16A) constant. That is, the scraping up body 16 and the adhesive roll 21 may be in non-contact with each other, and the distance between the brush front end portion of the scraping up body 16 and the outermost peripheral surface of the adhesive roll 21 is preferably about 2 to 3 mm in view of an adsorptiveness of the dust. In particular, as shown in FIG. 6, the supporting guide 22B mentioned above is provided so that the rotational shaft 22 of the adhesive roll 21 moves along an expected track M drawn in the frame 15 when the adhesive roll 21 is positioned so as to ride over an imaginary circle R around the rotational shaft 17 of the scraping up body 16 defined so that the adhesive roll 21 keeps the fixed distance relation mentioned above, and the contact rotating body 18, and the outer diameter of the adhesive roll 21 is reduced so as to be changed from a large circle to a small circle in FIG. 6 in correspondence to a consumption of the adhesive sheet 21A.

Further, a spring 22C corresponding to an urging means for downward urging the bearing slider 22A is installed within the supporting guide 22B provided in both side portions of the frame 15, and pressure contacts the adhesive roll 21 with the contact rotating body 18.

A dustpan body 23 is supported at a rear portion of the scraping up body 16 in the frame 15. The dustpan body 23 has a bottom surface portion 23A in contact with a floor surface, and a scooping surface portion 23B facing to the scraping up body 16 with no gap (or via a gap) and formed in a curved surface shape (or a flat surface shape), and flat supporting shaft portions 23C in both sides of the dustpan body 23 are supported at rectangular holes 24 formed in an oblique linear shape (a curved shape may be employed) rearward bent with respect to a vertical direction in both sides of the frame 15 so as to freely move in parallel along a vertical direction. The dustpan body 23 guides all the dust scraped up by the scraping up portion 16A of the scraping up body 16 to the adhesive roll 21 by the scooping surface portion 23B without missing the dust moving rearward along the floor surface, by vertically moving the supporting shaft portions 23C with respect to the rectangular holes 24 and bringing the bottom surface portion 23A and the lowermost end portion of the scooping surface portion 23B into contact with the floor surface with no gap due to their own weights.

Therefore, in accordance with the present embodiment, the following effects can be obtained.

(1) In the carpet, the dust is scraped up by the scraping up body 16 and thereafter the dust is adsorbed and picked up onto the adhesive roll 21. Since the adhesive roll 21 is not directly in contact with the carpet, the carpet is not damaged, it is possible to pick up the dust in the deep portion of the carpet fiber and a persistence of the adhesion performance of the adhesive roll 21 is improved.

(2) With respect to the flooring, in the same manner as that of the carpet, since the adhesive roll 21 is not directly in contact with the flooring, the adhesive roll 21 is not adhered to the flooring.

(3) The contact rotating body 18 is in contact with the adhesive roll 21 thereon and securely rotates the adhesive roll 21 in an interlocking manner. Accordingly, it is possible to always keep the adhesive surface of the adhesive roll 21 in contact with the scraping up body 16 due to the rotation, and it is possible to securely adsorb and pick up the dusts scraped up by the scraping up body 16 by the new adsorbing surface of the adhesive roll 21. At this time, since the adhesive roll 21 may ride over both of the scraping up body 16 and the contact rotating body 18 and the rotational shaft 22 of the adhesive roll 21 moves along the imaginary track M drawn in the frame 15, it is possible to use any kinds of adhesive rolls 21 having several kinds of large and small outer diameters to the cleaning device 10. Accordingly, a freedom of manufacturing can be given to the outer diameter of the adhesive roll 21, and it is possible to select the adhesive roll 21 having a proper outer diameter in correspondence to the floor condition.

(4) Since the rotational shaft 22 of the adhesive roll 21 is movably supported by the frame 15 and the adhesive roll 21 keeps a distance relation with respect to the outer diameter of the scraping body 16 constant (the distance of 0 or a small gap A) even when the outer diameter of the adhesive roll 21 is gradually reduced, the rotation operating force applied to the scraping body 16 and the contact rotating body 18 by the user is not made heavy, and it is possible to stably and securely move the dust scraped up by the scraping up body 16 to the adhesive roll 21 so as to improve a performance of picking up the dust.

That is, in the case that the distance between the adhesive roll 21 and the outer diameter of the scraping up body 16 is small, there is a risk that the adhesive roll 21 adhered to the front end of the flocked fabric of the scraping up portion 16A in the scraping up body 16 is gradually attracted to the side of the scraping up body 16 in correspondence to the rotation of the both, gradually increases the adhesive length with respect to the flocked fabric and finally sinks into a valley portion between the scraping up body 16 and the contact rotating body 18 so as to prevent rotation.

Further, when the gap between the adhesive roll 21 and the outer diameter of the scraping up body 16 becomes too large, the dust scraped up by the scraping up body 16 cannot stably and securely reach the side of the adhesive roll 21.

The distance relation between the adhesive roll 21 and the outer diameter of the scraping up body 16 is preferably 1 to 10 mm, and more preferably about 3 mm. In this case, when the material of the flocked fabric of the scraping up body 16 affects a peeling property which is hard to be adhered to the adhesive roll 21 or the like, it is possible to set the gap between the both to 0.

(5) Since the adhesive roll 21 is movably supported to the frame 15 and is strongly pressure contacted with the contact rotating body 18 by the spring 22C (the urging means), it is possible to firmly adhere the dust on the surface of the adhesive roll 21. Further, since the adhesive roll 21 is backed up and supported by the spring 22C (the urging means), the adhesive roll 21 does not jump up even when passing through the contact point with respect to the contact rotating body 18 while holding the dust, and there is no dust drop due to the vibration of the jump-up.

(6) Since the dusts attached on the surface of the adhesive roll 21 is strongly pressure contacted with the surface of the adhesive roll 21 as mentioned in the item (5) above, the dust is pressed flat without forming lumps in some portions on the surface of the adhesive roll 21. Accordingly, the previously attached lump-shaped dust does not largely protrude forward from an unused surface of the adhesive roll 21 so as to prevent the new dust from moving forward, and it is possible to effectively use all the surface of the adhesive roll 21 and to increase an amount of dust picked up onto the adhesive roll 21.

As the adhesive roll used in the present invention, a structure obtained by detachably covering a cylindrical sheet on a core roll may be used. At this time, an original form of the cylindrical sheet is formed in a sheet type envelope-like sheet, and a lot of envelope-like sheets can be laminated with each other so as to be stored.

Further, in accordance with the present invention, the scraping up body is not limited to the brush, and may be constituted by a sponge, a rubber blade, an elastomer, an elastic projection body or the like.

Further, in accordance with the present invention, the contact rotating body is not limited to the roll body, and may be constituted by a tire or the like. Further, the contact rotating body is not limited to the structure constituted by the elastic body, and may be constituted by an inelastic body.

Further, in accordance with the present invention, the floor surface is constituted by a tatami mat, flooring, a carpet or the like, and a significant and unique effect can be obtained against the carpet.

As mentioned above, in accordance with the present invention, it is possible to stably clean both of the carpet and the flooring for a long time.

Further, in accordance with the present invention, it is possible to improve the operability of the cleaning device by the user and it is possible to improve the performance of picking up the dust.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be embodied within a scope encompassed and equivalents thereof with respect to the features set out in the appended claims.

What is claimed is:

1. A cleaning device comprising:

a frame;

a scraping up body;

an adhesive roll;

a rotating body having a radius that varies along an axis of rotation of the rotating body, the rotating body rolling with the adhesive roll; and means for contacting said adhesive roll with the rotating body, thereby causing said adhesive roll to rotate with the rotating body, wherein the scraping up body and the rotating body are rotatably supported by the frame, the adhesive roll is arranged to rotate in parallel with the scraping up body and the rotating body.

2. A cleaning device according to claim 1, wherein an outer periphery of the adhesive roll contacts at least an outer periphery of the scraping up body.

3. A cleaning device according to claim 1, wherein a supporting guide for a rotating shaft of the adhesive roll is provided along an expected track which the rotating shaft of the adhesive roll draws on the frame when an outer diameter of the adhesive roll is reduced.

4. A cleaning device according to claim 1, wherein a biasing means is provided which makes the adhesive roll pressure contact with the rotating body.

5. A cleaning device according to claim 1, wherein the adhesive roll is positioned to maintain a constant distance from an outer periphery of the scraping up body.

6. A cleaning device according to claim 1, wherein the scraping up body comprises a brush, a sponge, a rubber blade, an elastomer, or an elastic projection.

7. A cleaning device comprising:

a frame;

a scraping up body;

an adhesive roll; and a rotating body having a concavo-convex portion, said rotating body rolling with the adhesive roll;

means for contacting said adhesive roll with the rotating body, wherein the scraping up body and the rotating body are rotatably supported by the frame, the adhesive roll is arranged to rotate in parallel with the scraping up body and the rotating body, and the adhesive roll is positioned to maintain a constant distance from an outer periphery of the scraping up body.

8. A cleaning device according to claim 7, wherein an outer periphery of the adhesive roll contacts at least an outer periphery of the scraping up body.

9. A cleaning device according to claim 7, wherein a supporting guide for a rotating shaft of the adhesive roll is provided along an expected track which the rotating shaft of the adhesive roll draws on the frame when an outer diameter of the adhesive roll is reduced.

10. A cleaning device according to claim 7, further comprising means for biasing, which causes the adhesive roll to pressure contact the rotating body.

11. A cleaning device according to claim 7, wherein the adhesive roll is positioned to maintain a constant distance from an outer periphery of the scraping up body.

12. A cleaning device according to claim 7, wherein the scraping up body comprises a brush, a sponge, a rubber blade, an elastomer, or an elastic projection.

13. A cleaning device according to claim 7, wherein the concavo-convex portion comprises at least one of a rib, a convex portion, a recess portion, and a crimping surface.

14. A cleaning device comprising:

a frame;

a scraping up body;

an adhesive roll;

a rotating body having a concavo-convex portion, said rotating body rolling with the adhesive roll; and means for contacting said adhesive roll with the rotating body, thereby causing said adhesive roll to rotate with the rotating body, wherein the scraping up body and the rotating body are rotatably supported by the frame, the adhesive roll is arranged to rotate in parallel with the scraping up body and the rotating body.

15. A cleaning device according to claim 14, wherein an outer periphery of the adhesive roll contacts at least an outer periphery of the scraping up body.

16. A cleaning device according to claim 14, wherein a supporting guide for a rotating shaft of the adhesive roll is provided along an expected track which the rotating shaft of the adhesive roll draws on the frame when an outer diameter of the adhesive roll is reduced.

17. A cleaning device according to claim 14, further comprising means for biasing, which causes the adhesive roll to pressure contact the rotating body.

18. A cleaning device according to claim 14, wherein the adhesive roll is positioned to maintain a constant distance from an outer periphery of the scraping up body.

19. A cleaning device according to claim 14, wherein the scraping up body comprises a brush, a sponge, a rubber blade, an elastomer, or an elastic projection.

20. A cleaning device according to claim 14, wherein the concavo-convex portion comprises at least one of a rib, a convex portion, a recess portion, and a crimping surface.

* * * * *